United States Patent [19]

Landen, deceased et al.

[11] 4,024,995

[45] May 24, 1977

[54] SAFETY DISPENSER FOR AN AEROSOL DISPENSER

[76] Inventors: William James Landen, deceased, late of Cheshire, Conn.; Paulette S. Landen, executrix, 30 Fairwood Drive, Cheshire, Conn. 06410

[22] Filed: Sept. 20, 1973

[21] Appl. No.: 398,843

[52] U.S. Cl. ..... 222/402.11

[51] Int. Cl.[2] ..... B65D 83/14

[58] Field of Search ..... 222/402.11, 182

[56] References Cited

UNITED STATES PATENTS

| | | | |
|---|---|---|---|
| 3,282,471 | 11/1966 | Lehmann | 222/182 |
| 3,734,353 | 5/1973 | McIlhenny | 222/402.11 |
| 3,734,354 | 5/1973 | Gach | 222/402.11 |
| 3,744,682 | 7/1973 | Blank | 222/402.11 |

*Primary Examiner*—Stanley H. Tollberg

*Assistant Examiner*—Hadd Lane

*Attorney, Agent, or Firm*—Hopgood, Calimafde, Kalil, Blaustein & Lieberman

[57] ABSTRACT

The invention contemplates an aerosol container construction, and in particular a dispensing cap construction for integration with or assembly to existing aerosol containers, whereby safety features are incorporated to materially reduce the hazard of child dispensing of harmful contents. The construction makes it necessary to follow a particular sequence of two different deliberate actuating displacements before any contents of the container can be dispensed, and the size and placement of manual-access surfaces for performing these displacements are such that a small child cannot make the requisite actuations with the fingers of one hand; on the other hand, these size and placement proportions are such as to readily accommodate adult use, with the fingers of one hand.

11 Claims, 8 Drawing Figures

Fig. 1.
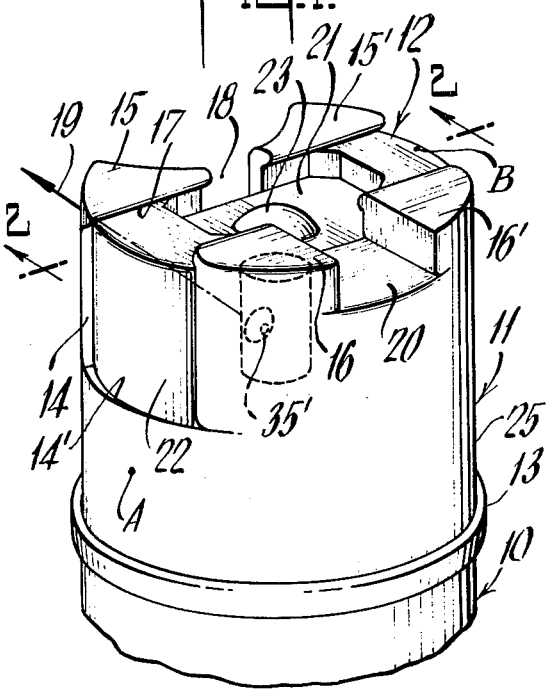
Fig. 2.
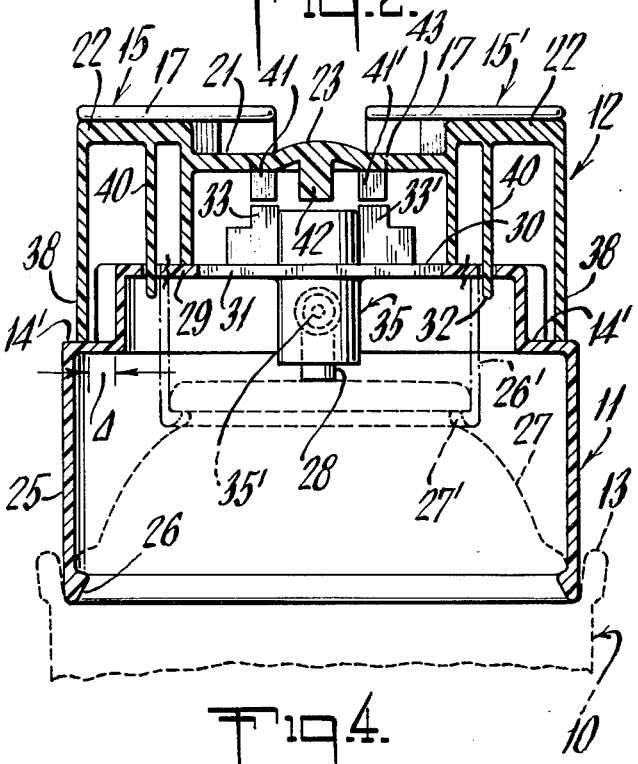
Fig. 3.
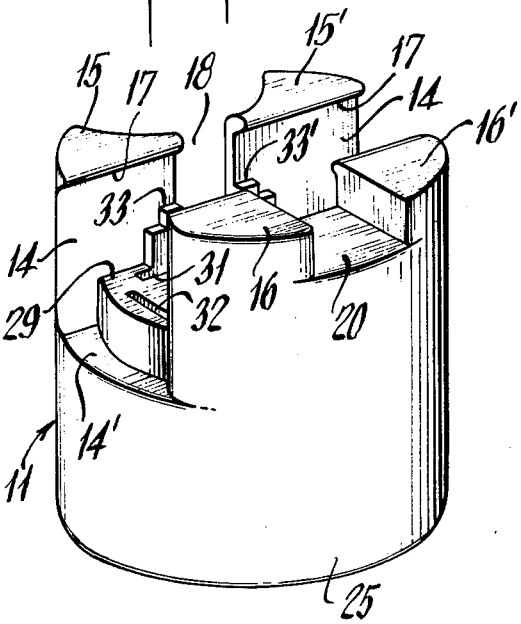
Fig. 4.
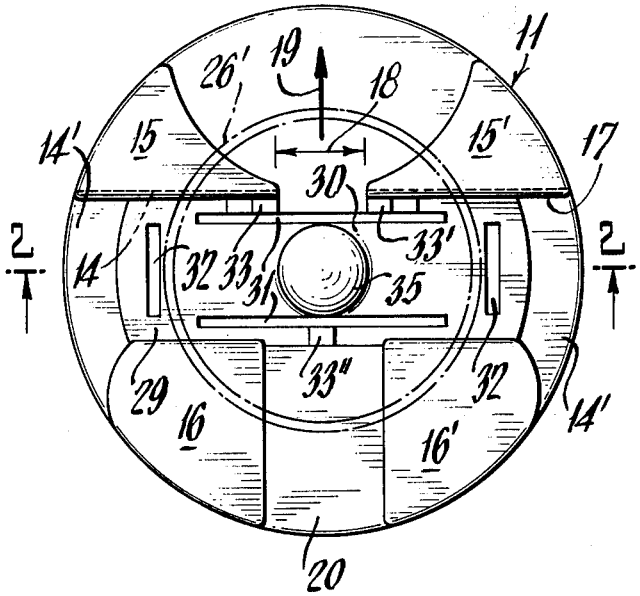
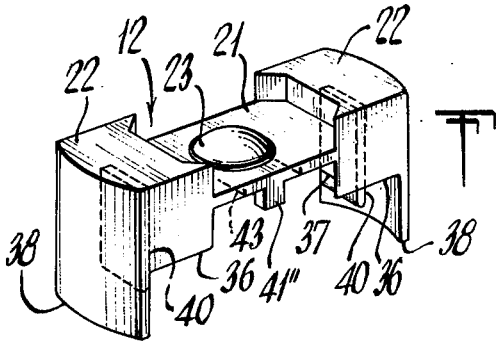
Fig. 3A.

SAFETY DISPENSER FOR AN AEROSOL DISPENSER

The invention relates to aerosol containers and in particular to safety mechanisms intended to frustrate child use of such containers.

It is an object of the invention to provide an improved container construction of the character indicated.

Another object is to provide a closure assembly for permanent attachment to the dispensing end of a conventional aerosol container, to thereby embody the indicted child-safey feature in the container.

A specific object is to achieve the foregoing objects with structure in which only one sequence of two independent actuating displacements can achieve the aerosol-dispensing function.

A further object is to achieve the above specific object in a construction wherein the fingers of one hand of a child are inherently incapable of actuating a dispensing function, yet wherein the size and placement of requisite actuable members is such that dispensing can be readily achieved by single-handed adult manipulation.

A still further object is to achieve the foregoing objects in a construction wherein, once dispensing action has started, it no longer is necessary to manually maintain the initial procedural displacement.

Another specific object is to provide the function of automatic full return to the initial safety-locked condition of such containers, once a discharging actuation is released.

It is also a specific object to meet the above objects with a construction involving as few as only two parts.

It is a general object to achieve the indicated objects with basically simple and foolproof mechanism, of inherently low cost, and readily assembled with requisit precision to a filled aerosol container.

Other objects and various further features of novelty and invention will be pointed out or will occur to those skilled in the art from a reading of the following specification, in conjunction with the accompanying drawings. In said drawings, which show, for illustrative purposes only, preferred forms of the invention:

FIG. 1 is a fragmentary view in perspective to show the dispensing end of an aerosol container incorporating the safety-dispensing feature of the invention;

FIG. 2 is an enlarged sectional view taken in a plane which includes the longitudinal axis of the container and from the asepct 2—2 of FIG. 1;

FIGS. 3 and 3A are similar perspective views to show the respective unassembled two parts of the safety-dispensing mechanism of FIGS. 1 and 2;

FIG. 4 is a plan view of the part shown in FIG. 3;

Figure 5:
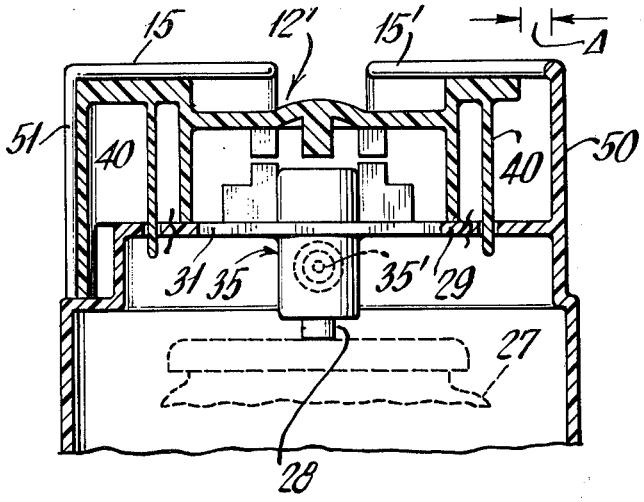
FIG. 5 is a view similar to FIG. 2, to illustrate a modification.

Functional use of the embodiment of FIGS. 1 to 4 is best appreciated from FIG. 1 alone, which shows a cylindrical aerosol container 10 into which safety mechanism of the invention has been incorporated at the dispensing end. The safety mechanism is a permanent assembly of two members 11–12, permanently assembled to container 10 within the outer diameter of the chime 13 by which the pressurized upper end of the container is closed; the members 11–12 may be injection-molded of suitable plastic, such as ABS, polypropylene, or high-density polyethylene.

In spite of the permanent assembly of members 11–12, they are nevertheless formed for mutually guided relative motion, in a single degree of freedom and between certain limits. In the form shown, this relative motion extends diametrically, and the member 12 has freedom for straight-line reciprocation within the guiding confines of opposed channel walls 14, the latter being portions of upper axial end formations 15–15′ and 16–16′ of the member 11; ribs, as at 17 and provided at the upper ends of all walls 14, retain the smaller member 12 in its guided assembly to the larger member 11, and the latter is permanently secured to the axial end of container 10. Member 12 is shown in its central position in channel 14, being normally thus positioned by compliant means to be later described; it may be shifted in either direction along channel 14, against the force reaction of such compliant means, and such a shift is a necessary first condition of actuating access to container contents.

The adjacent end formations 15–15′ on one lateral side of member 12 are physically spaced at 18 to allow for central spray of container contents into the atmosphere, along the single generally radial direction suggested by heavy arrow 19; on the other hand, the separation of formations 16–16′ is such as to define a relatively shallow radial groove 20, providing single-finger alignment for access to a central, axially-downwardly yieldable bridge 21 which integrally connects opposed-end guide-block formations 22 of member 12. Bridge 21 may have a locally raised central dome 23 by which an actuating finger aligned by groove 20 may compliantly depress the central part of the bridge.

As thus described, it will be appreciated that the container of FIG. 1 may be grasped by the fingers of one hand. For a right-handed person, the thumb will naturally engage member 11 in the region A below channel 14, while the forefinger will naturally have access to bridge 21 via groove 20, and while the remaining three fingers complete the grasping engagement to member 11 and to the adjacent region of the container body. The middle finger is uppermost and is relatively available for independent motion, without impairing the grasp of the container; the middle finger is thus readily positionable in the distant end of channel 14 and in actuating contact at B with the adjacent guide-block formation 22 of member 12.

As will later be made clear, the internal arrangement of the described parts is such that for the normally central position of member 12 in channel 14, axial interferences preclude aerosol-valve actuation. However, when member 12 has been shifted to an extent sufficiently offset from this central position, the interferences are avoided, so that a depression of the central region of the bridge 21 will be immediately operative to produce discharge in the direction 19. Thus, for the described right-hand grasp, and upon a sufficient radially directed forefinger force at B, member 12 may be shifted leftward in channel 14 to clear the internal interferences, thus enabling the forefinger to actuate the discharge. As long as the discharge is continued thereafter, the middle finger may be removed. But once the forefinger is relaxed to cut off the discharge, the internal compliance forces return of member 12 to its central position, wherein forefinger actuating access to bridge 21 is denied, in the absence of another unlocking shift of member 12, by force applied at B.

What has been said of right-handed operation applies equally for left-handed operation, the points of thumb and middle-finger contact being diametrically reversed, and the necessary lateral shift of member 12 being to the right in channel 14, in the sense of FIG. 1.

Having thus identified the structure from the point of view of its manipulative use, the details will be more fully described in the added context of FIGS. 2 to 4.

The large member 11 is seen as a generally cupped single piece, wherein the lower end or body 25 is open and cylindrical. A radially inward bead 26 or the like at the open end of the body bore has tight and permanent resilient locking engagement under the rim of a locking groove in the end-closure cap or bell 27 which supports the dispensing valve of the container, the upstanding neck of this valve being identified at 28 in FIG. 2. The described spaced end formations 15–15′–16–16′ are angularly spaced in the "closed" upper end of member 11; and the channel bottom, between walls 14, is essentially a straight flat platform 29, stepped down at 14′ at its respective ends. In its central region, platform 29 is locally weakened at 30 for axial deflection, as by spaced parallel slots 31 which symmetrically straddle the central-axis alignment of the container. Further symmetrically located outer slots 32 in platform 29 enable connection to compliant means to be described, and a plurality of dog or lug formations 33–33′–33″ integral with and rising above platform 29 are also integral with adjacent walls 14, to provide firm reference for the axial interference to be later more fully described. To complete the description of member 11, a nozzle body 35 of conventional shape and nature is preferably integrally formed with the weakened strip 30 between slots 31, being shown with its nozzle opening 35′ directed at 90° to the guide direction of channel 14 and located below the plane of platform 29.

The smaller member 12, best seen in FIGS. 2 and 3A, is also a single piece, wherein the bridge 21 integrally connects the two guide-block formations 22, each of which is an inverted cup, so that only full surfaces are upwardly and laterally exposed. The base edges 36–37 of these inverted cups are slidable on platform 29, and the outer sides project further downwardly at 38, in close clearance with or slidable on the stepped-down surfaces 14′, so that the respective steps between surfaces 14′ and platform 29 may be stops for limiting abutment with the skirt projections 38. The limits of shiftability of member 12 in channel 14 are thus, for right-ward displacement (from the center position shown) when the left skirt projection 38 abuts the adjacent step, and for left-ward displacement, when the right skirt projection 38 abuts the adjacent step.

Compliant restoration to the central position shown is achieved by two strips 40, each integrally depending from the closed upper end wall of a guide-block cup 22 and projecting through the adjacent slot 32 of platform 29. As shown, the strips 40 are of generally rectangular section, the "flat" dimension of which is transverse to the deflection direction which accompanies any shift of member 12 from its normally central position. In this normally central position, integral dog or lug formations 41–41′–41″ depend from bridge 21 at the peripheral region of dome 23 and are in axial register with the corresponding lugs 33–33′–33″ respectively. The extent Δ of possible lateral shift of member 12 away from its normal central position is preferably just slightly in excess of the effective region of axially interfering overlap of lugs 33–33′–33″ and 41–41′–41″, so that full or substantially full lateral displacement of member 12 is needed to clear the interference relation. Having made such displacement, a central projection 42 (FIG. 3A) on bridge 21 is free to engage and depress nozzle 35 for aerosol discharge at 35′.

The embodiment of FIGS. 1 to 4 serves also to illustrate a technique whereby bridge 21 is essentially only downwardly actuable, when the axial interference is avoided by shift of member 12. Spaced transverse slits 43 (FIG. 3A) on the lower side of bridge 21 are so formed that watever the driven direction or force accompanying shift of member 12, bridge 21 will be substantially straight and in uniform compression. When the interference is cleared, downward displacement of dome 23 is facilitated by these slits, but the full bridge thickness is presented as a deterrent to any tampering (as by prying with a tool) which might seek to raise bridge 21 from its normally straight and flat condition.

FIG. 5 will be recognized for its close similarity to FIG. 2 and therefore the same reference numbers are used where applicable. The point of difference is that in FIG. 5, the shiftable member 12′ is movable in only one direction away from the normally central, axial-interference position shown. A closed wall 50 integrally connects formations 15′–16′ to deny middle-finger access to one end of the channel 14, the adjacent guide-block formation 22′ being appropriately truncated to permit the necessary clearance Δ; and an outer detent rib or the like 51 on one or both walls 14 at the opposite end of the guide channel serves as a deterrent to any attempt leftward displacement of member 12′. The device of FIG. 5 will thus only operate for a right-ward displacement of member 12′ to clear the axial interference, the compliance of deflected members 40 again serving to return the parts to their safe condition.

Figure 6:
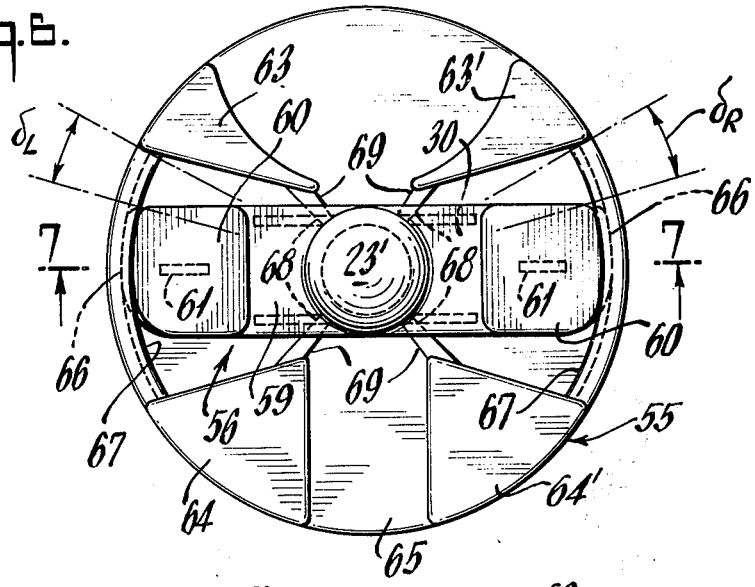
FIG. 6 is a plan view of an assembled safety dispensing mechanism, representing a further modification.
Figure 7:
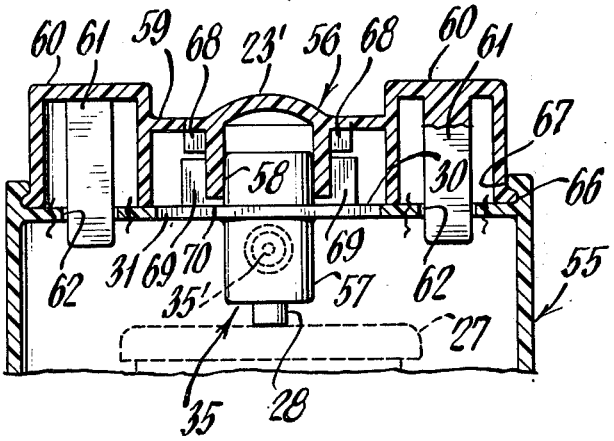
FIG. 7 is a view similar to FIGS. 2 and 5, but taken at the plane 7—7 of FIG. 6.

FIGS. 6 and 7 illustrate a variation of the invention which again utilizes two relatively movable assembled members 55–56 and wherein the nozzle member 35 is carried by a weakened strip 30 in the larger member 55. The point of difference is that the freedom for guided relative motion is rotational rather than lineal. The larger member 56 is again secured to the container end, with nozzle 35 properly poised in relation to the valve neck 28, but the upwardly projecting body part 57 of nozzle 35 is used as a stud on which a depending boss formation 58 of member 56 is pivotable. Boss 58 depends from an axially (downwardly) yieldable bridge 59 between finger-engageable inverted-cup wings or projections 60. With each such cupped projection 60, an integral flat compliant strip 61 projects to engage a radial slot 62 in the adjacent wall surface of member 55. Axially upwardly projecting formations 63–63′ in member 55 define stops to limit rotary displacement of member 56 in either direction away from the normal "centrally positioned" relationship shown in FIG. 6; the stressed condition of cantilevered strips 60 away from this relationship will be understood to provide continuous application of force to return the parts to this central position. Further upward projections 64–64′ in member 55 restrict access to member 56 and define the shallow groove 65 for forefinger use as already described. Retaining formations 66–67 preserve integrity of the assembly, and axial interference is accomplished for the central position, using spaced lugs 68 formed on the underside of bridge 59, adjacent boss 58, and in register with corresponding spaced lugs 69 on member 55 (outside the axially weakened region thereof, not shown but of nature as described at 30 in FIGS. 2 and 4).

In use, the device of FIGS. 6 and 8, is operable only by first rotating member 56 against one of the stops 63–63′ and against the compliant reaction force of springs 60. Once the axial interference at 68–69 has been cleared by such rotation, forefinger depression of dome 23′ will engage the lower edge of boss 58 to a local portion 70 of the weakened strip by which nozzle 35 is carried. The continued application of forefinger actuation for discharge will relieve the need for further deliberate rotation of member 56, and after forefinger release, the parts will be returned to closed position. The construction if FIGS. 6 and 7 is thus adaptable to right or left-hand operation, the rotary displacements necessary to clear the axial interferences being designated $\Delta_R$ and $\Delta_L$ in FIG. 6.

The described invention will be seen to have achieved all stated objects. In application to standard aerosol container dimensions, e.g., chime diameter at 13 of about 2.5 inches, the finger span necessary to simultaneously or sequentially shift the movable member (12, 12′, 56) and gain forefinger access to the dome region 23 (23′) is too great for the fingers of one hand of a small child, yet the proportions are convenient for the fingers of an adult hand.

While the invention has been described in detail for the preferred forms shown, it will be understood that modifications may be made without departure from the invention. For example, the manner of anchoring the larger member 11 to the container 10 at the chime region 13 is purely illustrative, and other forms of attachment may prove more desirable or effective, as suggested by phantom outline 26′ in FIGS. 2 and 4; said outline 26′ will be understood to suggest a downwardly open skirt, integral with the platform 29, projections 15–15′–16–16′ and such other parts of member 11 as are intercepted at a radius to pass between slots 32 and 31. Skirt 26′ is shown with a circumferentially continuous inward locking bead which has permanent snap-locking engagement under the lip of groove 27′ at the upper crown of the container end panel or bell 27.

What is claimed is:

1. A safety closure and dispensing unitary assembly for application to the discharge-valve end of a cylindrical aerosol container, comprising first and second one-piece parts in mutually retained relation and having freedom for guided relative motion between first and second positions, one of said parts having container-end engaging and locking formations such that when locked to a container end the guided relative motion of said parts is in a plane generally transverse to the container axis, the other of said parts having an axially downwardly manually deflectable portion in generally axial registry over the central region of the container and when assembled to an aerosol container, an aerosol nozzle body integrally formed with and downwardly movable upon downward manual deflection of said deflectable portion, said nozzle body having a lateral discharge opening on an axis transverse to the container axis, the external contouring of said one part being such as to define a clear local arc of aerosol dischargeability, said axis of the lateral discharge opening being centrally disposed within said arc, compliant means integral with one of said parts and reacting between said parts and normally positioning said parts in said first position, axially interfering formations on and integrally formed with said parts preventing axial deflection of said deflectable portion when said parts are in said first position and being free of axial interference when said parts are in said second position, whereby said unitary assembly may be assembled to a charge aerosol container upon coaxial registry of said nozzle body with the valve neck of the container and without need for particular angular orientation, the thus-equipped container being then in readiness for valve-depressed use upon first sufficiently relatively moving said parts against the action of said compliant means and from said first position to the extent of removing said interfering formations from axially interfering relation.

2. The assembly of claim 1, in which said guided relative motion is substantially radial with respect to the axis of a container locked to said assembly.

3. The assembly of claim 1, in which said guided relative motion is rotary with respect to the axis of a container locked to said assembly.

4. The assembly of claim 1, in which said first and second positions are limits of said motion, whereby only by prior movement in the direction of said second position can an assembled container be actuated via said manually deflectable portion.

5. The assembly of claim 1, in which said second position is one of two limits of said motion on opposite sides of said first position, whereby only by prior movement in the direction of one of said limits can an assembled container be actuated via said manually deflectable portion.

6. The assembly of claim 5, in which said axially deflectable portion of said second member includes a generally diametrically extending strap which interconnects opposed manually accessible integral opposed bodies, and diametrically extending guide-channel means for said bodies on said first member.

7. The assembly of claim 6, in which said strap has a transverse slit on its underside, the side walls of the slitted portion being in abutment whensaid strap is generally flat, whereby axial deflectability of said strap is primarily in the direction downward of said generally flat condition thereof.

8. The assembly of claim 1, in which said interfering formations of said one member are radially offset locations spaced angularly about the actuation axis of said nozzle.

9. The assembly of claim 1, in which said compliant means includes a deflectable part having integral cantilevered connection at one end to one of said members, the other of said members having a slot engaged by the free end of said deflectable part.

10. A safety closure and dispensing unitary assembly for application to the discharge-valve end of a cylindrical aerosol container, comprising first and second integral one-piece parts in mutually retained relation and having limited freedom for quided relative motion between first and second limits of such motion, the first of said parts having container-end engaging and locking formations such that when locked to a container end the guided relative motion of said parts is in a plane generally transverse to the container axis, compliant means integral with one of said parts engaging the other of said parts and positioning said parts in a mid position between said limits, axially interfering formations on and integrally formed with said parts preventing axial deflection of the center of said other part in the direction of said one part when said parts are in said mid position relation, said interfering formations being out of axial register and therefore non-interfering when said parts are positioned at one of said limits, the central region of said other part being axially deflectable into actuating relation with the discharge-valve end of said container when in one of said non-interfering positions, an aerosol nozzle body integrally formed with and downwardly movable upon downward manual deflection of said deflectable central region, said nozzle body having a lateral discharge opening on an axis transverse to the container axis, the external contouring of said one part being such as to define a clear local arc of aerosol dischargeability, said axis of the lateral discharge opening being centrally disposed within said arc, said first part including a body with said engaging and locking formations and with said interfering formations, and an aerosol actuator with integral axially compliant connection to said body, said nozzle having a discharge orifice unidirectionally oriented generally radially in said plane, said body having axially projecting formations at opposite angular offsets from the nozzle discharge direction, and said second part being quided on said body on the side of said projections angularly remote from the nozzle-discharge direction.

11. The assembly of claim 10, in which said body includes two further axially projecting formations that are spaced sufficient to define a radially directed finger-access groove providing unidirectional finger access to said axially deflectable region, the radial directions of finger access and of nozzle discharge being substantially opposite.

* * * * *